United States Patent [19]

Ichinose et al.

[11] 4,170,770

[45] Oct. 9, 1979

[54] GAS LEAK-DETECTING APPARATUS

[75] Inventors: Noboru Ichinose, Yokohama; Hideo Ohkuma, Kawasaki; Takashi Takahashi, Tokyo; Masayoshi Takei, Kunitachi, all of Japan

[73] Assignees: Tokyo Shibaura Electric Co., Ltd., Kawasaki; Masayoshi Takei, Tokyo, both of Japan

[21] Appl. No.: 839,452

[22] Filed: Oct. 5, 1977

[30] Foreign Application Priority Data

Oct. 8, 1976 [JP] Japan ..... 51-121027

[51] Int. Cl.[2] ..... G08B 17/10

[52] U.S. Cl. ..... 340/634; 340/605

[58] Field of Search ..... 340/237, 248 B, 634, 340/663, 605; 137/392; 318/227; 73/27 R; 324/71 SM

[56] References Cited

U.S. PATENT DOCUMENTS

| | | | |
|---|---|---|---|
| 3,403,315 | 9/1968 | Maynard | 318/227 |
| 3,407,840 | 10/1968 | Finnegan | 137/392 |
| 3,588,892 | 6/1971 | Scheidweiler | 340/237 S X |
| 3,602,251 | 8/1971 | Hill | 137/392 |
| 3,801,974 | 4/1974 | Aitken | 340/248 B |
| 3,887,908 | 6/1975 | Swigert | 340/237 R |

*Primary Examiner*—John W. Caldwell, Sr.
*Assistant Examiner*—Daniel Myer
*Attorney, Agent, or Firm*—Oblon, Fisher, Spivak, McClelland & Maier

[57] ABSTRACT

A gas leak-detecting apparatus which comprises an alarm circuit; a gas-detecting circuit electrically separated from the alarm circuit and provided with a gas-sensitive element prepared from an oxide semiconductor; and a contactless coupling circuit for operating the alarm circuit by an output from the gas-detecting circuit.

10 Claims, 6 Drawing Figures

GAS LEAK-DETECTING APPARATUS

This invention relates to a gas leak-detecting apparatus which detects gas leaks by a gas-sensitive element prepared from an oxide semiconductor, and sends forth a signal for actuating a device capable of giving an alarm, displaying gas leaks or stopping such occurrences as need arises.

An oxide semiconductor such as $SnO_2$ or ZnO is known to decrease in resistance when gas is adsorbed thereto. The degree of said decrease varies with the kind of oxide semiconductor and the type of gas adsorbed thereto. However, a gas leak-detecting apparatus has already been put to practical application which detects gas leaks by a gas-sensitive element prepared from the above-mentioned oxide semiconductor, and, when required, gives an alarm.

The prior art gas leak-detecting apparatus essentially has such a circuit arrangement as shown in FIG. 1. One terminal of an AC 100 V power source is connected to one terminal of the primary winding 3 of a transformer 2 serving two power sources, and also to one terminal of a buzzer 4. The other terminal of the buzzer 4 is connected to the anode of a thyristor 5, whose cathode is connected to one terminal of the secondary winding 6 of the transformer 2 and also to the other terminal of the primary winding 3. The other terminal of the secondary winding 6 is connected to one terminal of a heater 8 of an indirectly heated gas-sensitive device 7 through one heater terminal 9. The other terminal of the heater 8 is connected to a tap 11 on the secondary winding 6 of the transformer 2 through the other heater terminal 10. One terminal of a gas-sensitive element 12 (equivalently indicated as a resistor) received in a gas-sensitive device 7 is connected to one of the stationary terminals of a variable resistor 14 through a detection terminal 13. The other stationary terminal of the variable resistor 14 is connected to said one terminal of the secondary winding 6 of the transformer 2.

A slidable terminal is connected through a forward disposed diode 15 to a gate terminal of the thyristor 5, said gate terminal being connected through a resistor 16 to a cathode of the thyristor 5 and also to said one terminal of the secondary winding 6 of the transformer 2.

Where the AC power source 1 arranged as described above is connected to the prior art gas leak-detecting device, power is normally conducted from the secondary winding 6 of the transformer 2 serving two power sources to the heater 8 of the gas-sensitive device 7. As the result, the gas-sensitive element 12 is heated to the prescribed level of temperature by the heat generated in the heater 8. The gas-sensitive element 12 receives bias current of the prescribed magnitude through the variable resistor 14 from the secondary winding 6. Where any gas is not detected, the slidable terminal of the variable resistor 14 is shifted to prevent the thyristor 5 from being triggered by current running through the gas-sensitive element 12, thereby controlling voltage impressed on the gate terminal of the thyristor 5.

Where, under the above-mentioned condition, the prescribed gas is adsorbed, to the gas-sensitive element 12, then its resistance drops with the resultant increase in the voltage impressed on the variable resistor 14. The increased voltage is conducted through the diode 15 to the gate terminal of the thyristor 5. As the result, the thyristor 5 is rendered conductive, causing the buzzer 14 to be energized by the power source 1. Thus, the buzzer 4 issues an alarm indicating gas leaks.

Where, however, the circuit parts of the above-mentioned conventional gas leak-detecting device were assembled on a single print substrate, there resulted the drawback that said detecting device was very likely to present an erroneous behavior. The principal reason is that the alarming circuit (including the buzzer 4 and thyristor 5 shown in FIG. 1) and the gas-detecting circuit (including the transformer 2, gas-sensitive device 7, variable resistor 14 and diode 15 indicated in FIG. 1) were not electrically separated from each other. Namely, as apparent from FIG. 1, both buzzer circuit and gas-detecting circuit were operated by alternating current. The same part of both circuits was used in common. Moreover, an output from the gas-detecting circuit was delivered through the diode 15 to the thyristor 5 acting as the switch element of the alarming circuit. Therefore, the prior art gas leak-alarming device often indicated erroneous behaviors due to the decreased insulation of the constituent circuits resulting from increases in ambient temperature and humidity and also due to the occurrences of leakage current and the emissions of noises from the power source.

As seen from the circuit arrangement of FIG. 1, the transformer 2 is used as the power source of the heater 8 of the gas-sensitive device 7 as well as the bias power source of the gas-sensitive element 12. Therefore, fluctuations in the AC power source 1 lead to fluctuation in both the power source of the heater 8 and the bias power source of the gas-sensitive element 12. For example, changes in the AC power source 1 give rise to variations in the power source of the heater 8 and the temperature of the gas-sensitive element 12 and consequently in the resistance of said element 12. As the result, the terminal of the variable resistor 14 is impressed with fluctuating levels of voltage, regardless of whether gas is present or absent. In this case, the power source of the heater 8 and the bias power source of the gas-sensitive element 12 change with the same phase, thus affecting variations in the voltage impressed on the terminal of the variable resistor 14. Namely, a drop in the voltage of the power source of the heater 8 and the bias power source of the gas-sensitive element 12 results in a decline in the terminal voltage of the variable resistor 14. Accordingly, any slight fluctuation in the power source voltage eventually gives rise to a prominent change in that voltage of an output from the gas-detecting circuit which is impressed on the gate terminal of the thyristor 5. Therefore, the prior art gas leak-detecting device presented such erroneous behaviors that an alarm failed to be issued when gas leaks occurred, and conversely an alarm was given, though no gas leak arose.

It is accordingly the object of this invention to provide a gas leak-detecting apparatus which is saved from erroneous behaviors caused by, for example, declines in the insulation of the constituent circuits resulting from increases in ambient temperature and humidity, as well as by occurrences of leakage current, noises and fluctuations in the power source voltage.

The gas leak-detecting apparatus of this invention is essentially characterized in that an output circuit including a buzzer circuit is electrically separated from a gas-detecting circuit formed of a gas-sensitive device. To this end, therefore, an output signal from the gas-detecting circuit is supplied to an output circuit for energizing, for example, a buzzer circuit through a contactless coupling circuit, for example, a photocoupler or magnet switch. Further, DC current free from the effect of fluctuations in AC voltage is preferably used as the power source of the gas-detecting circuit, namely, the bias power source of the gas-sensitive element and the power source of the heater. As later described, however, AC may be used as the power source of the heater. But this arrangement little reduces the advantageous effect of the present invention.

According to an aspect of the invention, there is provided a gas leak-detecting apparatus which comprises a gas-detecting circuit including a first power source and a gas-sensitive device energized by said first power source and provided with a gas-sensitive element prepared from an oxide semiconductor; an output circuit which includes a second power source, switch and load circuits all connected in series between the terminals of said second power source and moreover is electrically separated from said gas-detecting circuit; and means for supplying an output from the gas-detecting circuit to the switch circuit by a contactless process to control said switch circuit in accordance with the magnitude of said output.

This invention can be more fully understood from the following detailed description when taken in conjunction with the accompanying drawings, in which.

Figure 1:
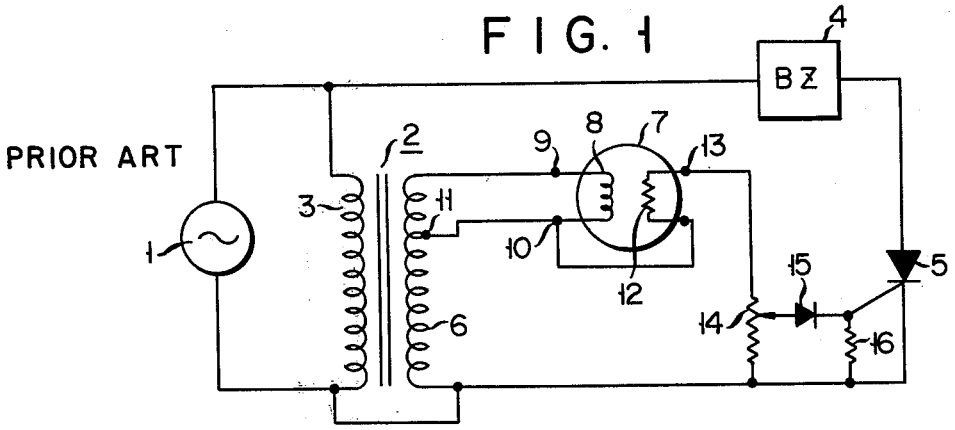
FIG. 1 is a circuit diagram of the prior art gas leak-alarming device.
Figure 2:
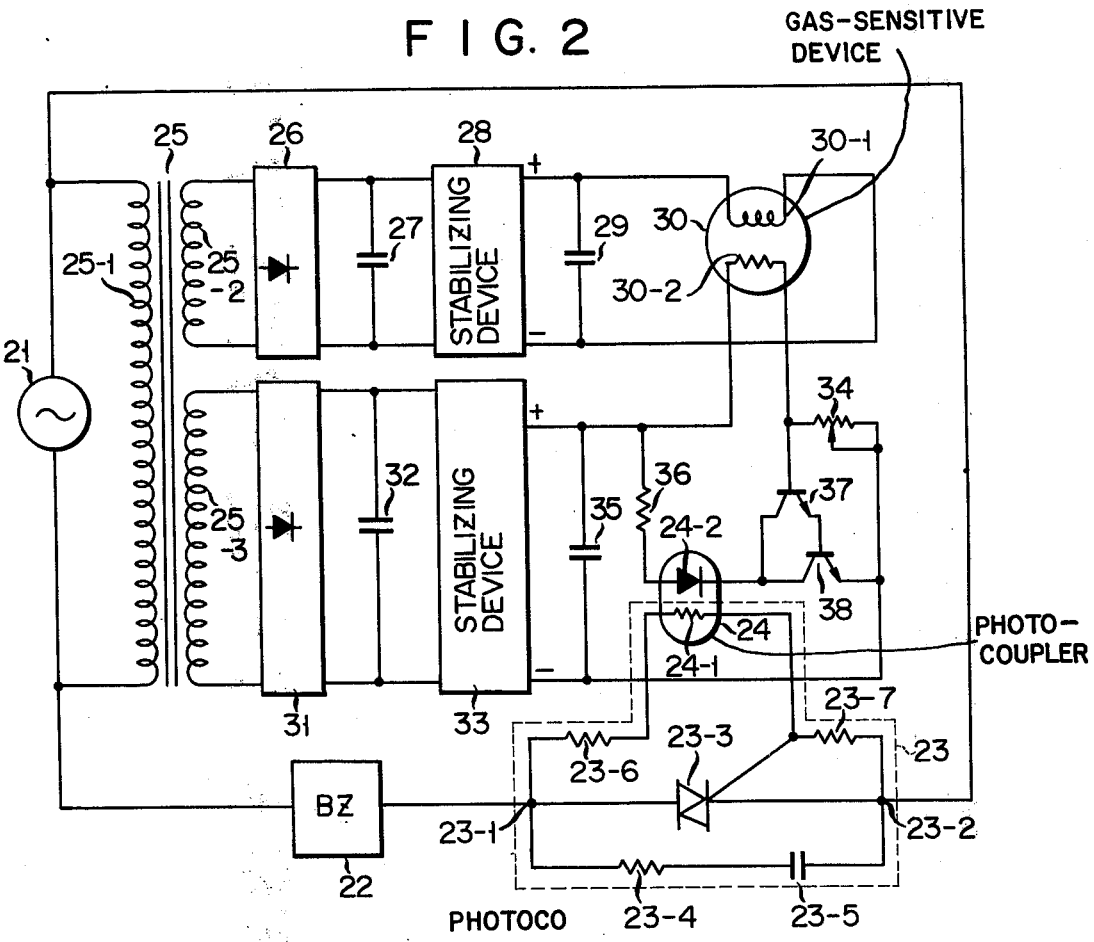
FIG. 2 is a circuit diagram of a gas leak-detecting apparatus according to one embodiment of this invention.

Referring to FIG. 2, a buzzer device 22 acting as a load and a switch circuit 23 enclosed in dotted lines are connected in series between the terminals of a commercial AC power source of, for example, 100 V 50 cycles. The switch circuit 23 is provided with external contact terminals 23-1, 23-2, between which a triac 23-3 is connected. A circuit formed of a resistor 23-4 and a capacitor 23-5 connected in series is further provided between said external contact terminals 23-1, 23-2. This series circuit serves as a protective circuit for the subject gas leak-detecting apparatus against a surge voltage impressed from an AC power source 21. Connected in series between the external contact terminals 23-1, 23-2 are a resistor 23-6, a light-receiving element 24-1 of a photocoupler 24 and a resistor 23-7. The junction of the light-receiving element 24-1 and resistor 23-7 is connected to a gate of the triac 23-3. The light-receiving element 24-1 is a photosensitive resistor whose resistance varies upon receipt of a light from a light-emitting element 24-2 supplied with an output from the later described gas-detecting circuit.

There will now be described the arrangement of the gas-detecting circuit. The AC power source 21 is connected to both ends of a primary winding 25-1 of a transformer 25 serving two power sources. The secondary winding of the two-power-source-type transformer 25 is divided into a first secondary winding 25-2 and a second secondary winding 25-3. Both ends of the first secondary winding 25-2 are connected to both input terminals of a rectifier 26, whose output terminals are connected to both ends of a smoothing capacitor 27 and also to both input terminals of a DC stabilizing device 28. An output voltage from the DC stabilizing device 28 is impressed on both ends of a smoothing capacitor 29 and also across both terminals of a heater 30-1 of an indirectly heated gas-sensitive device 30.

Both ends of the second secondary winding 25-3 of the aforesaid transformer 25 are connected to both input terminals of a rectifier 31 whose output terminals are connected to both ends of a smoothing capacitor 32 and also to both input terminals of a DC stabilizing device 33. The plus side output terminal of the stabilizing device 33 is connected to one end of a gas-sensitive element 30-2 prepared from an oxide semiconductor and received in the gas-sensitive device 30. The minus side output terminal of the stabilizing device 33 is connected to the other end of the gas-sensitive element 30-2 through a variable resistor 34. The plus side output terminal of the stabilizing device 33 is connected to one end of a smoothing capacitor 35, the other end of which is connected to the minus side output terminal of the stabilizing device 33. The plus side output terminal of the stabilizing device is further connected through a resistor 36 to one end of a light-emitting element 24-2 (for example, a light-emitting diode) of the photocoupler 24. The other end of said light-emitting diode 24-2 is connected to the collectors of transistors 37, 38. The emitter of the transistor 37 is connected to the base of the transistor 38. Thus both transistors 37, 38 constitute a Darlington-connected amplifier. The base of the transistor 37 is connected to the plus terminal of the stabilizing device 33 through the gas-sensitive element 30-2. The emitter of the transistor 38 is connected to the minus terminal of said stabilizing device 38.

Referring to FIG. 2, the DC stabilizing circuit 28 is used as the power source of the heater 30-1. The DC stabilizing circuit 33 serves is the bias power source of the gas-sensitive element 30-2. This arrangement prevents output voltages from the DC stabilizing circuits 28, 33 from being fluctuated by variations in the voltage of the AC power source 21. Further, since an output circuit formed of the buzzer device 22 and switch circuit 23 is connected to the gas-detecting circuit only through the photocoupler 24, the gas-detecting circuit is saved from erroneous behaviors caused by, for example, declines in insulation resulting from increases in ambient temperature and humidity as well as by occurrences of leakage current and noises.

There will now be described the operation of the gas leak-detecting apparatus of this invention whose circuit arrangement is shown in FIG. 2. The heater 30-1 is normally heated to the prescribed temperature by a DC output from the stabilizing device 28. The base of the transistor 37 included in the Darlington circuit is impressed with a division of the DC bias voltage which is divided by the gas-sensitive element 30-2 and the variable resistor 34. Now let it be assumed that the variable resistor 34 has such a resistance as allows gas the base current of the transistor 37 to run upon receipt of isobutane gas at a concentration of 0.2%. Where the concentration of the isobutane gas exceeds 0.2% with the resultant decline in the resistance of the gas-sensitive element 30-2 and consequently in the base potential of the transistor 37, then the transistors 37, 38 are rendered conductive. Accordingly, the DC current from the stabilizing device 33 flows through the light-emitting diode 24-2 which in turn gives off a light. A light from the diode 24-2 is supplied to the light-receiving element 24-1, whose resistance decreases according to an amount of light received, leading to a drop in the voltage impressed across both terminals of the light-receiving element 24-1, and in consequence a rise in the voltage impressed across both terminals of the resistor 23-7. As the result, the triac 23-3 is rendered conductive, causing the buzzer device 22 to issue a gas leak alarm.

With the embodiment of FIG. 2, the buzzer device 22 was energized by the conduction of the triac 23-3 and issued a gas leak alarm. However, it is possible to cause a lamp to flicker for display of gas leaks or automatically to stop gas leaks by actuating an electromagnetic valve.

Figure 3:
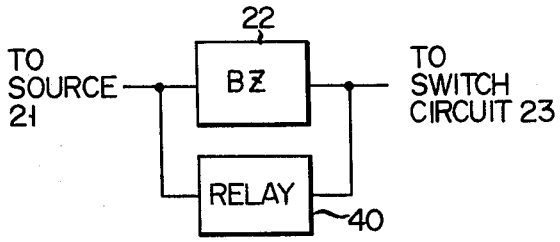
FIG. 3 is a modification of the load circuit of FIG. 2.

FIG. 3 represents the last mentioned case. Namely, a relay 40 for driving an electromagnetic valve is connected in parallel to the buzzer device 22 of FIG. 2. Under this arrangement, the buzzer device 22 is energized by conduction of the triac 23-3 and gives off a gas leak alarm. The relay 40 is also actuated to drive an electromagnetic valve (not shown), thereby automatically closing the stopcock through which gas leaks.

Figure 4:
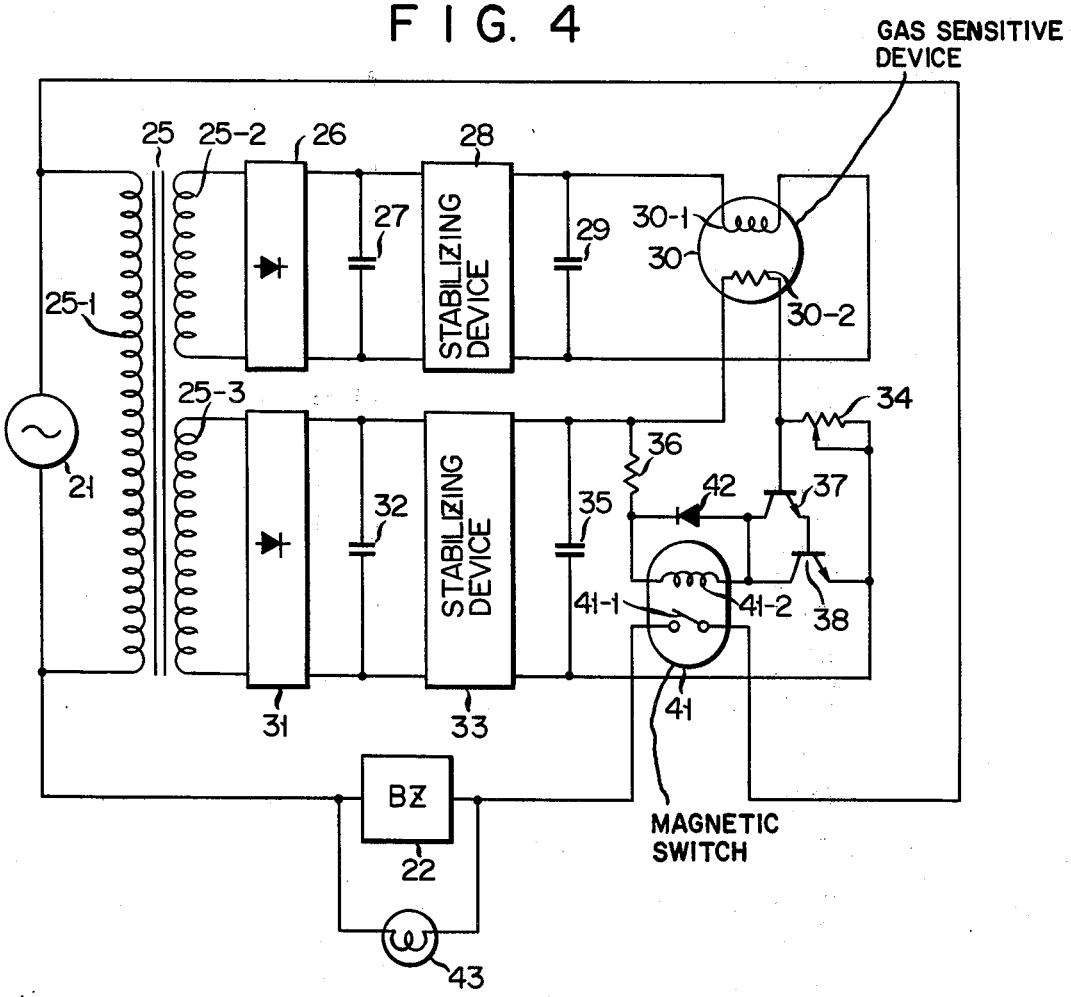
FIG. 4 is a circuit diagram of a gas leak-detecting apparatus according to another embodiment of the invention.

There will now be described the circuit arrangement of a gas leak-detecting apparatus according to another embodiment of this invention. With this embodiment, the contactless coupling circuit for operating the alarm circuit by an output from the gas-detecting circuit includes a magnetic switch 41 substituted for the photocoupler 24 of FIG. 2. The parts of FIG. 4 the same as those of FIG. 2 are denoted by the same numerals. The magnetic switch 41 comprises a reed switch 41-1 connected to the power source 21 in series with the buzzer device 22, and an electromagnetic coil 41-2 connected between both output terminals of the stabilizing device 33 in series with the resistor 36 and transistor 38. A diode 42 is connected in parallel to the electromagnetic coil 41-2. The diode 42 eliminates voltage induced in the electromagnetic coil 41-2. The embodiment of FIG. 4 has essentially the same arrangement and operation as that of FIG. 2. Namely, where the gas-sensitive element 32 senses the prescribed amount of gas and the terminal voltage of the gas-detecting resistor 34 increases, then the Darlington-connected transistors 37, 38 are rendered conductive, causing current to run through the electromagnetic coil 41-2 of the magnetic switch 41. A magnetic field generated in the electromagnetic coil 41-2 closes the reed switch 41 to energize the buzzer device 22. If, in this case, a lamp 43 is connected, as shown in FIG. 4, in parallel with the buzzer device 22, then gas leaks are indicated not only by an alarm given by the buzzer device 22 but also a light issued from the lamp 43.

As mentioned above, the output circuit and gas-detecting circuit of the gas leak-detecting apparatus embodying this invention are electrically separated from each other, causing an output from the gas-detecting circuit to be supplied to the output circuit by a contactless process. Consequently, the present gas leak-detecting apparatus is reliably saved from erroneous behaviors caused by, for example, declines in insulation resulting from increases in ambient temperature and humidity, as well as by occurrences of leakage current and noises. The gas-detecting circuit of the gas leak-detecting apparatus of this invention comprises two independent DC stabilizing power sources used as the bias power source of the gas-sensitive device and the power source of the heater respectively. Particularly where DC power source is used as the bias power source of the gas-sensitive device and heater power source, an output from the gas-detecting circuit is not affected by the power source of the output circuit. Namely, the synergetic effect of changes in the bias power source of the gas-sensitive device and heater power source which occur concurrently in the same direction as in the prior art AC-operated gas leak-detecting device is eliminated, thereby preventing the erroneous behaviors of the gas leak-detecting apparatus of this invention. Therefore, the present gas leak-detecting apparatus is substantially saved from erroneous behaviors and proves its merits as a device for forestalling hazards to human life.

Figure 5:
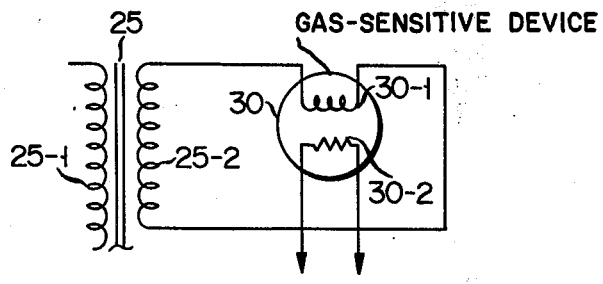
FIG. 5 is a circuit diagram of a modification of the heater power source used in the first and second embodiments of the invention.
Figure 6:
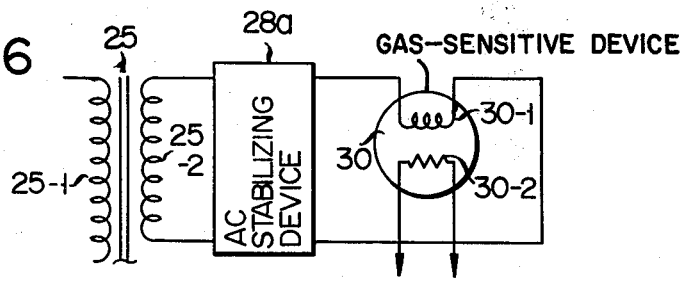
FIG. 6 is a circuit diagram of another modification of said heater power source.

This invention is not limited to the foregoing embodiments but may obviously be applicable in many other modification without changing the object of the invention. For example, it is possible, as shown in FIG. 5, to connect the heater 30-1 of the gas-sensitive device 30 directly to the first secondary winging 25-2 of the transformer 25 or, as shown in FIG. 6, to stabilize an AC output from said first secondary winding 25-2 by the AC stabilizing device 28*a* and supply the stabilized form of the AC output to the heater 30-1 of the gas-sensitive device 30.

What we claim is:

1. A gas leak-detecting apparatus comprising a gas-detecting element having a heater and an oxide semiconductor to be heated indirectly by the heater; a first power source between the output terminals of which the heater is connected; a second power source; a gas-detecting circuit connected in series between the output terminals of the second power source and including the oxide semiconductor and the input circuit of a non-contact type switch; a third power source; and an alarm circuit connected in series between the terminals of the third power source and including the output circuit of the non-contact type switch and an alarm element.

2. The gas leak-detecting apparatus according to claim 1, wherein the second power source is a commercial AC type; the first power source comprises a transformer serving two power sources and comprising a primary winding connected to the AC power source and first and second secondary windings, a first rectifier circuit connected to the first secondary winding, a first stabilizing device connected to the output terminal of the first rectifier circuit, a second rectifier circuit connected between both ends of the second secondary winding, and a second DC stabilizing device connected to the output terminal of the second rectifier circuit; and the gas-sensitive device comprises a heater impressed with an output voltage from the first stabilizing device and a gas-sensitive element impressed with an output voltage from the second stabilizing device through a variable detection resistor.

3. The gas leak-detecting apparatus according to claim 2, wherein the gas-detecting circuit comprises a Darlington amplifier circuit activated by the terminal voltage of the variable detection resistor, and a light-emitting element connected to the DC output terminal of the second stabilizing device in series with the Darlington amplifier circuit; the switch circuit comprises a light-receiving element constituting a photocoupler with the light-emitting element supplied with a light sent forth from the light-emitting element, a voltage-dividing resistor connected in series to the light-receiving element, a triac connected to the AC power source, and means for impressing the gate terminal of the triac with the terminal voltage of the voltage-dividing resistor.

4. The gas leak-detecting apparatus according to claim 3, wherein a series circuit formed of a resistor and capacitor is connected in parallel to the triac to prevent the occurrence of surge voltage.

5. The gas leak-detecting apparatus according to claim 2, wherein the gas-detecting circuit comprises a Darlington amplifier circuit activated by the terminal voltage of the variable detection resistor, and an electromagnetic coil connected to the DC output terminal of the second stabilizing device in series with the Darlington amplifier circuit; and the switch circuit comprises a reed switch connected to the AC power source to cause the contact of said reed switch to be closed by a magnetic field generated in the electromagnetic coil.

6. The gas leak-detecting apparatus according to claim 1, wherein the load circuit is a buzzer.

7. The gas leak-detecting apparatus according to claim 6, wherein the load circuit comprises a relay connected in parallel to the buzzer to activate an electromagnetic valve for closing a gas stopcock.

8. The gas leak-detecting apparatus according to claim 6, wherein the load circuit comprises a display lamp connected in parallel to the buzzer.

9. The gas leak-detecting apparatus according to claim 1, wherein the second power source is a commercial AC type; the first power source comprises a transformer provided with a primary winding connected to the commercial AC power source and first and second secondary windings to serve two power sources, a rectifier circuit connected between both ends of the second secondary winding, and a DC stabilizing device connected to the output terminal of the rectifier circuit; and the gas-sensitive device comprises a heater supplied with AC voltage from the first secondary winding and a gas-sensitive element supplied with an output voltage from the DC stabilizing device through a variable detection resistor.

10. The gas leak-detecting apparatus according to claim 1, wherein the AC stabilizing circuit is connected between the first secondary winding of the transformer and the heater of the gas-sensitive device.

* * * * *